US012018419B2

(12) United States Patent
Jin et al.

(10) Patent No.: US 12,018,419 B2
(45) Date of Patent: Jun. 25, 2024

(54) STACK-TYPE LAUNDRY TREATING APPARATUS

(71) Applicant: LG Electronics Inc., Seoul (KR)

(72) Inventors: Donghyun Jin, Seoul (KR); Daehan Kwon, Seoul (KR); Sangho Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 201 days.

(21) Appl. No.: 17/186,972

(22) Filed: Feb. 26, 2021

(65) Prior Publication Data

US 2021/0269957 A1 Sep. 2, 2021

(30) Foreign Application Priority Data

Feb. 28, 2020 (KR) ..... 10-2020-0025338

(51) Int. Cl.
*D06F 29/00* (2006.01)
*D06F 25/00* (2006.01)
*D06F 39/12* (2006.01)

(52) U.S. Cl.
CPC ..... *D06F 29/005* (2013.01); *D06F 25/00* (2013.01); *D06F 39/125* (2013.01)

(58) Field of Classification Search
CPC ..... D06F 39/14; D06F 29/005; D06F 25/00; D06F 39/125
See application file for complete search history.

(56) References Cited

U.S. PATENT DOCUMENTS

2004/0244439 A1* 12/2004 Hee Han ..... D06F 39/12 68/23 R
2005/0178164 A1* 8/2005 Kim ..... D06F 34/28 68/3 R
2007/0119216 A1* 5/2007 Jeong ..... D06F 29/00 68/3 R (Continued)

FOREIGN PATENT DOCUMENTS

DE 102015114472 3/2017
KR 20060098825 9/2006

(Continued)

OTHER PUBLICATIONS

Machine English Translation of Description of DE 10-2015-114472 A1 (Seysen et al.) (Year: 2017).*

(Continued)

*Primary Examiner* — Joseph L. Perrin
*Assistant Examiner* — Irina Graf
(74) *Attorney, Agent, or Firm* — Fish & Richardson P.C.

(57) ABSTRACT

A stack-type laundry treating apparatus includes upper and lower treating apparatuses. The upper treating apparatus includes an upper cabinet, a drying drum configured to receive an object to be dried, an upper driver for rotating the drying drum, and an air flow path for supplying and discharging air to and from the drying drum. The upper cabinet includes an upper front panel defining a front face of the upper cabinet, upper side panels respectively defining both side faces of the upper cabinet, a decoration panel coupled to a top of the upper front panel, and an upper top panel contacting the decoration panel such that movement of the upper top panel is limited by the decoration panel. The upper top panel is coupled to the upper side panels.

18 Claims, 8 Drawing Sheets

(56) References Cited

U.S. PATENT DOCUMENTS

| | | | | |
|---|---|---|---|---|
| 2007/0169520 | A1* | 7/2007 | Heo | D06F 29/00 68/3 R |
| 2007/0180868 | A1* | 8/2007 | Hur | D06F 39/12 68/3 R |
| 2009/0066205 | A1* | 3/2009 | Park | D06F 34/28 312/228 |
| 2009/0153004 | A1* | 6/2009 | Han | D06F 39/12 312/228 |

FOREIGN PATENT DOCUMENTS

| | | |
|---|---|---|
| KR | 20070067466 | 6/2007 |
| KR | 100879572 | 1/2009 |

OTHER PUBLICATIONS

Office Action in German Appln. No. 102021201771.1, dated Jun. 30, 2022, 8 pages (with English translation).

* cited by examiner

STACK-TYPE LAUNDRY TREATING APPARATUS

CROSS-REFERENCE TO RELATED APPLICATION

This application claims the benefit of Korean Patent Application No. 10-2020-0025338, filed on Feb. 28, 2020, which is hereby incorporated by reference as when fully set forth herein.

TECHNICAL FIELD

The present disclosure relates to a stack-type laundry treating apparatus, and more specifically, relates to a stack-type laundry treating apparatus in which a top structure of an upper or lower laundry treating apparatus may be improved to prevent inflow of water.

BACKGROUND

A laundry treating apparatus may be classified into a front-loading type laundry treating apparatus and a top-loading type laundry treating apparatus according to a manner in which laundry is input. Depending on a manner in which the laundry is treated, the laundry treating apparatus may be classified into a washing apparatus for washing the laundry and a drying apparatus for drying the laundry.

In recent years, the front loading type washing apparatus may have a reduced overall height and increased washing capacity, compared to the top loading type washing apparatus in which an inner tub as a washing tub rotates while standing upright. In the front loading type washing apparatus, twisting of the laundry hardly occur. Thus, demand of the front loading type washing apparatus is increasing.

The front-loading type washing apparatus includes a tub disposed inside a cabinet defining an appearance thereof, a drum rotatable inside the tub, and a driver that rotates the drum. The rotation of the drum may cause friction between the drum, a washing-water, and an object to be washed (laundry), thereby removing contaminations from the laundry.

Further, in recent years, a drying apparatus having an appearance similar to that of the front loading type washing apparatus is being manufactured. The drying apparatus includes a drying drum rotatable inside a cabinet, a driver that rotates the drying drum, and a hot air supply that supplies hot and dry air into the drum, thereby drying the laundry in a wet state after washing thereof is completed.

When the washing apparatus and the drying apparatus according to the prior art as described above are installed at the same time, the washing apparatus and the drying apparatus are installed side by side in a horizontal direction on an installation face.

However, when an installation space is narrow, the washing apparatus and the drying apparatus are separately installed in separate spaces, and the laundry that has been washed in the washing apparatus is moved/injected to the drying apparatus to dry the laundry.

Recently, a washing apparatus having a mount face or a mounting part for installing a drying apparatus thereon so that the drying apparatus may be stacked on a top of the washing apparatus has been commercially available.

However, as described above, in the washing apparatus and the drying apparatus according to the prior art which are stacked vertically, a front panel defining a front face of the apparatus is manufactured by press-forming a steel plate of a predetermined thickness. In order to form the front panel, a slit to form front and side faces of the front panel must be formed in a top face of the front panel.

However, through the slit formed in the top face of the front panel, water flowing from a top of the washing apparatus or the drying apparatus or water flowing from another apparatus located on the top of the washing apparatus or the drying apparatus may flow into an interior of the treating apparatus.

Therefore, when the washing apparatus or the drying apparatus is used alone, or when another treating apparatus is stacked on a top of the washing apparatus or the drying apparatus, an improved structure to prevent water from inflowing from the front panel of each treating apparatus is required.

SUMMARY

The present disclosure has been devised to solve the above problem. Thus, a purpose of the present disclosure is to provide a stack-type laundry treating apparatus in which an upper treating apparatus may be stacked on a top of a lower treating apparatus.

Further, the present disclosure has been devised to solve the above problem. Thus, a purpose of the present disclosure is to provide a stack-type laundry treating apparatus in which a top structure of the upper treating apparatus or the lower treating apparatus is improved to minimize inflow of water from a top face of the upper treating apparatus or the lower treating apparatus.

Purposes of the present disclosure are not limited to the above-mentioned purpose. Other purposes and advantages of the present disclosure as not mentioned above may be understood from following descriptions and more clearly understood from embodiments of the present disclosure. Further, it will be readily appreciated that the purposes and advantages of the present disclosure may be realized by features and combinations thereof as disclosed in the claims.

Particular implementations of the present disclosure provide a stack-type laundry treating system that includes upper and lower treating apparatuses. The upper treating apparatus may include an upper cabinet, a drying drum, an upper driver, and an air flow passage. The drying drum may be disposed in the upper cabinet and configured to rotate. The drying drum may be configured to receive an object to be dried. The upper driver may be configured to rotate the drying drum. The air flow passage may be configured to supply air to and discharge air from the drying drum. The lower treating apparatus may include a lower cabinet, a tub disposed in the lower cabinet and configured to receive washing-water, a washing drum disposed inside the tub and configured to receive an object to be washed, and a lower driver configured to rotate the washing drum. The upper cabinet may include an upper front panel defining a front face of the upper cabinet, upper side panels defining opposite side faces of the upper cabinet, a decoration panel coupled to a top of the upper front panel, and an upper top panel coupled to the upper side panels and supporting the decoration panel. The decoration panel may be configured to restrict movement of the upper top panel.

In some implementations, the system can optionally include one or more of the following features. The upper front panel may include a top bent portion that is coupled to the decoration panel, and side bent portions that are located at opposite sides of the upper front panel and contact the upper side panels. The decoration panel may be disposed on the top bent portion and extend along the top bent portion toward the side bent portions. Each of the side bent portions may include a connection end coupled to the top bent portion. The decoration panel may be disposed at the connection end. The top bent portion may define a plurality of mounting holes. The decoration panel may have a plurality of mounting protrusions that are inserted into the plurality of mounting holes of the top bent portion. The decoration panel may include a top plate having a shape corresponding to a shape of the top bent portion. The plurality of mounting protrusions of the decoration panel may be located at a bottom face of the top plate and correspond to positions of the plurality of mounting holes of the top bent portion. Each of the plurality of mounting holes of the top bent portion may have a rectangular shape extending in a first direction. The first direction may extend between opposite sides of the system. The plurality of mounting protrusions of the decoration panel may be configured to be received into and fixed at the plurality of mounting holes of the top bent portion based on the top plate moving in the first direction. Each of the plurality of mounting protrusions of the decoration panel may have a stopper protrusion that is spaced downward from the top plate and extends in a moving direction of the top plate. A top face of the stopper protrusion may have an inclined face that is inclined downward in the moving direction of the top plate. The top plate may include a rear face having a shape corresponding to a shape of a front end of the upper top panel to thereby support the front end of the upper top panel. The top plate may define a recess at a bottom face of the top plate. The top plate may include a support protrusion that is defined at an inner horizontal face of the recess and extends toward the top bent portion. The top bent portion may define a plurality of reinforcing grooves.

Particular implementations of the present disclosure provide a laundry treating apparatus that may include a cabinet, a drum disposed in the cabinet and configured to rotate, and a driver configured to rotate the drum. The cabinet may include a front panel defining a front face of the cabinet, side panels defining opposite side faces of the cabinet, a decoration panel coupled to a top of the front panel, and a top panel coupled to the side panels and contacting the decoration panel. The decoration panel may be configured to restrict movement of the top panel.

In some implementations, the system can optionally include one or more of the following features. The front panel may include a top bent portion on which the decoration panel is disposed. The top bent portion may define a plurality of mounting holes. The front panel may include side bent portions that are located at opposite sides of the front panel and contact the side panels. The decoration panel may include a top plate having a shape corresponding to a shape of the top bent portion, and a plurality of mounting protrusions that are located at a bottom face of the top plate and correspond to positions of the plurality of mounting holes of the top bent portion. Each of the side bent portions may include a connection end coupled to the top bent portion. The decoration panel may be disposed at the connection end. Each of the plurality of mounting holes may have a rectangular shape extending in a first direction. The first direction may extend between opposite sides of the apparatus. Each of the plurality of mounting protrusions may have a stopper protrusion that is spaced downward from the top plate and extends in a moving direction of the top plate. A top face of the stopper protrusion may have an inclined face that is inclined downward in the moving direction of the top plate. The top plate may include a rear face having a shape corresponding to a shape of a front end of the top panel to thereby support the front end of the top panel.

A first aspect of the present disclosure provides a stack-type laundry treating apparatus comprising: an upper treating apparatus including: an upper cabinet defining an upper appearance thereof; a drying drum rotatably disposed in the upper cabinet, wherein an object to be dried is inserted into the drying drum; an upper driver for rotating the drying drum; and an air flow path for supplying and discharging air to and from the drying drum; and a lower treating apparatus including: a lower cabinet defining a lower appearance thereof; a tub disposed in the lower cabinet, wherein washing-water is stored in the tub; a washing drum disposed inside the tub, wherein an object to be washed is inserted into the washing drum; and a lower driver for rotating the washing drum, wherein the upper cabinet includes: an upper front panel defining a front face of the upper cabinet; upper side panels respectively defining both side faces of the upper cabinet; a decoration panel coupled to a top of the upper front panel; and an upper top panel supporting the decoration panel such that movement of the upper top panel is limited by the decoration panel, wherein the upper top panel is coupled to the upper side panels.

In one implementation of the first aspect, the upper front panel includes: a top bent portion on which the decoration panel is installed; and side bent portions on both opposing sides of the upper front panel, wherein the side bent portions are in contact with the upper side panels, respectively.

In one implementation of the first aspect, the decoration panel extends along and on the top bent portion and to the side bent portions.

In one implementation of the first aspect, a connection end coupled to the top bent portion is formed on a top of each of the side bent portions, wherein the decoration panel extends onto a top of the connection end.

In one implementation of the first aspect, the top bent portion has a plurality of mounting holes defined therein, wherein the decoration panel has a plurality of protrusions inserted into the mounting holes.

In one implementation of the first aspect, the decoration panel includes: a top plate formed in a plate shape corresponding to a shape of the top bent portion; and a plurality of mounting protrusions formed on a bottom face of the top plate, wherein positions of the mounting protrusions correspond to positions of the mounting holes.

In one implementation of the first aspect, each mounting hole is formed in a rectangular shape extending in a lateral direction of the top bent portion, wherein the mounting protrusion is fixedly received into the mounting hole as the top plate moves in a lateral direction of the top bent portion.

In one implementation of the first aspect, the mounting protrusion has a stopper protrusion spaced downward from the top plate and extending in a moving direction of the top plate.

In one implementation of the first aspect, a top face of the stopper protrusion has an inclined face inclined downwards in the moving direction of the top plate.

In one implementation of the first aspect, a rear face of the top plate acts as a support face having a shape corresponding to a shape of a front end of the upper top panel.

In one implementation of the first aspect, a recess is defined in a bottom face of the top plate, wherein the recess is recessed upwardly into the top plate.

In one implementation of the first aspect, a support protrusion extending toward the top bent portion is formed on an inner horizontal face of the recess.

In one implementation of the first aspect, the top bent portion has a plurality of reinforcing grooves defined therein.

A second aspect of the present disclosure provides a laundry treating apparatus comprising: a cabinet defining an appearance; a drum rotatably disposed in the cabinet; and a driver for rotating the drum, wherein the cabinet includes: a front panel defining a front face of the cabinet; side panels respectively defining both side faces of the cabinet; a decoration panel coupled to a top of the front panel; and a top panel supporting the decoration panel such that movement of the top panel is limited by the decoration panel, wherein the top panel is coupled to the side panels.

In one implementation of the second aspect, the front panel includes: a top bent portion on which the decoration panel is installed, wherein the top bent portion has a plurality of mounting holes defined therein; and side bent portions on both opposing sides of the front panel, wherein the side bent portions are in contact with the side panels, respectively.

In one implementation of the second aspect, the decoration panel includes: a top plate formed in a plate shape corresponding to a shape of the top bent portion; and a plurality of mounting protrusions formed on a bottom face of the top plate, wherein positions of the mounting protrusions correspond to positions of the mounting holes.

In one implementation of the second aspect, a connection end coupled to the top bent portion is formed on a top of each of the side bent portions, wherein the decoration panel extends onto a top of the connection end.

In one implementation of the second aspect, each mounting hole is formed in a rectangular shape extending in a lateral direction of the top bent portion, wherein the mounting protrusion has a stopper protrusion spaced downward from the top plate and extending in a moving direction of the top plate.

The present disclosure may realize the stack-type laundry treating apparatus in which the upper treating apparatus may be stacked on a top of the lower treating apparatus.

Further, the present disclosure may realize the stack-type laundry treating apparatus in which a top structure of the upper treating apparatus or the lower treating apparatus is improved to minimize inflow of water from a top face of the upper treating apparatus or the lower treating apparatus.

In addition to the effects as described above, specific effects of the present disclosure will be described together with the detailed description for carrying out the disclosure.

DETAILED DESCRIPTION

Figure 1:
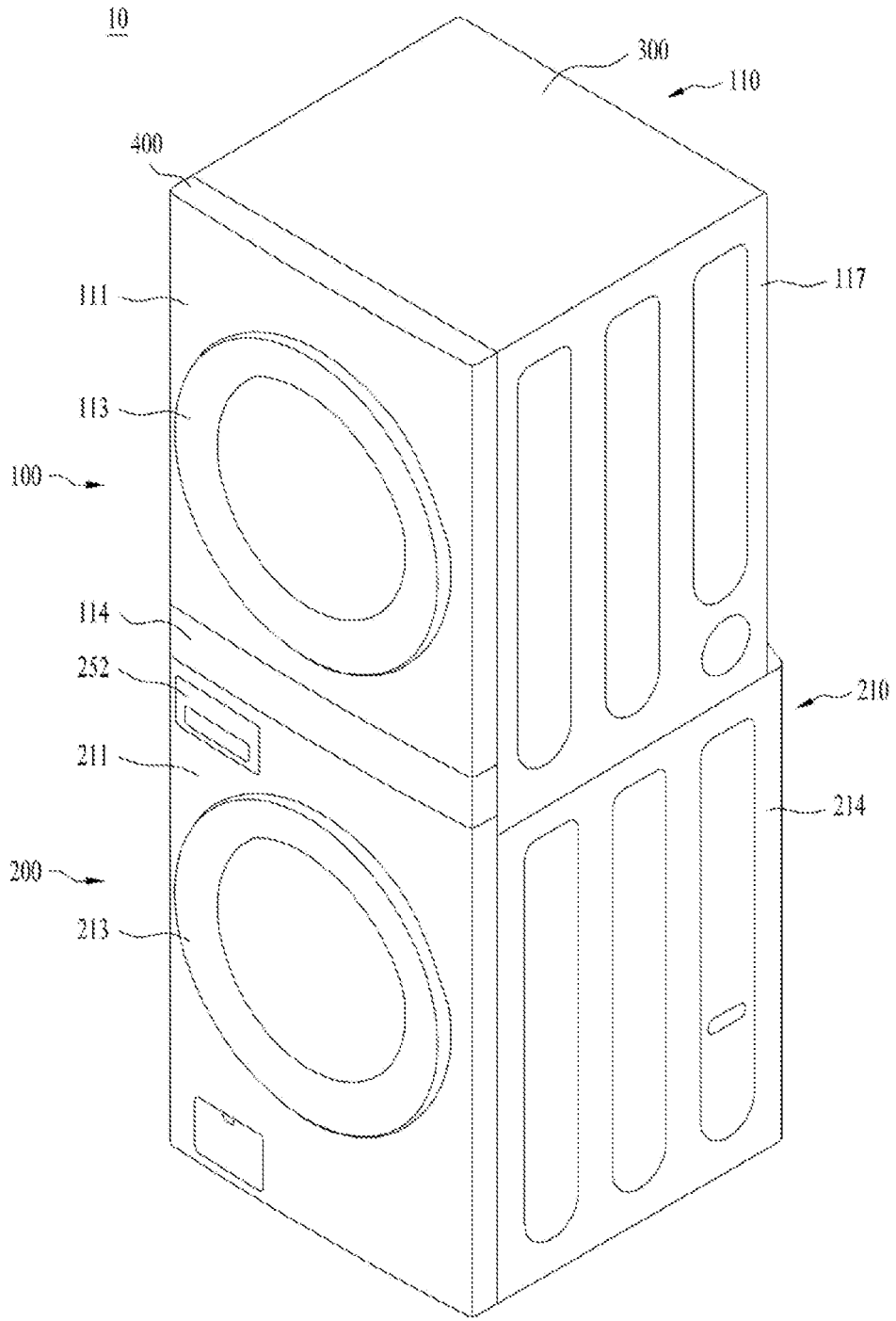
FIG. 1 is a perspective view showing a laundry treating apparatus according to the present disclosure.

Hereinafter, a laundry treating apparatus according to an embodiment of the present disclosure will be described in detail.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

For simplicity and clarity of illustration, elements in the figures are not necessarily drawn to scale. The same reference numbers in different figures denote the same or similar elements, and as such perform similar functionality. Moreover, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" a second element or layer, the first element may be disposed directly on the second element or may be disposed indirectly on the second element with a third element or layer being disposed between the first and second elements or layers. It will be understood that when an element or layer is referred to as being "connected to", or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof.

As used herein, the term "and/or" includes any and all combinations of one or more of the associated listed items. Expression such as "at least one of" when preceding a list of elements may modify the entire list of elements and may not modify the individual elements of the list.

First, each of components of a laundry treating apparatus according to an embodiment of the present disclosure will be described in detail with reference to the accompanying drawings.

Figure 2:
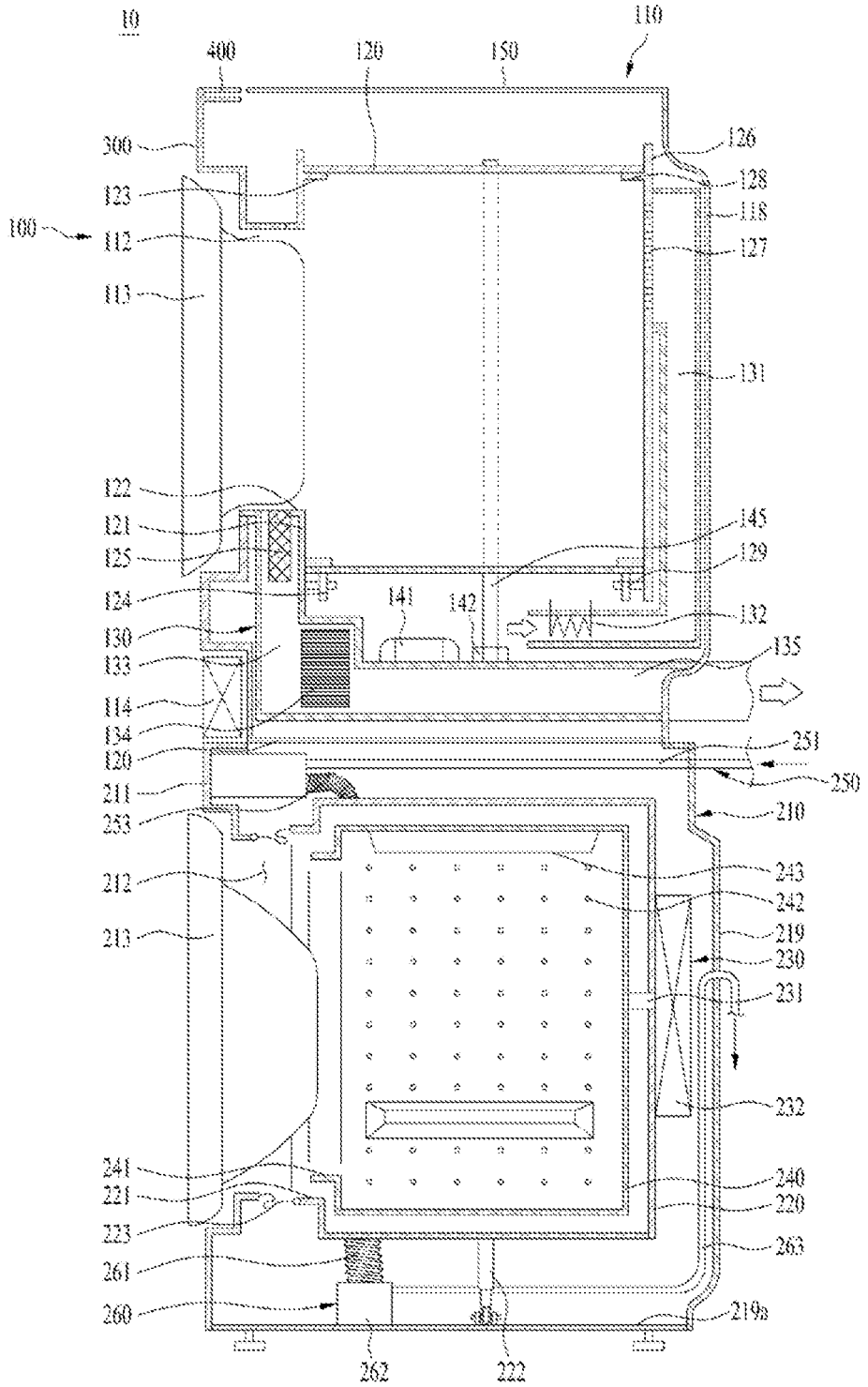
FIG. 2 is a simplified diagram showing an internal structure of the laundry treating apparatus according to the present disclosure.

FIG. 1 is a perspective view showing a laundry treating apparatus according to the present disclosure. FIG. 2 is a simplified diagram showing an internal structure of the laundry treating apparatus according to the present disclosure.

As shown in FIG. 1 to FIG. 2, a laundry treating apparatus 10 according to the present disclosure includes a washing apparatus (hereinafter, referred to as 'lower treating apparatus 200') that performs washing and rinsing of an object to be washed (laundry), and a drying apparatus (hereinafter, referred to as 'upper treating apparatus 100') that is mounted on a top of the lower treating apparatus 200 and performs drying of an object to be dried (laundry) that has been washed or needs to be separately dried.

The drying apparatus corresponding to the upper treating apparatus 100 may use a gas burner, an electric heater, a heat pump, etc. as a heat source. Hereinafter, in the present disclosure, an example in which the upper treating apparatus 100 corresponding to the drying apparatus uses the electric heater as the heat source will be described.

However, the present disclosure is not limited thereto. The drying apparatus corresponding to the upper treating apparatus 100 may use the gas burner, the heat pump, etc. as a heat source. That is, as long as when the drying apparatus includes main components of the upper treating apparatus 100, the drying apparatus should be regarded as the upper treating apparatus 100 according to the present disclosure regardless of a type of the heat source of the drying apparatus.

The upper treating apparatus 100 includes an upper cabinet 110 defining an upper appearance thereof and including an upper front panel 300, an upper top panel 150, an upper side panel 117, an upper rear panel 118 and an upper base panel 119, a drying drum 120 rotatably disposed inside the upper cabinet 110 and receiving and drying an object to be dried using heated air supplied thereto, an air flow path 130 for supplying the heated air to the drying drum 120 and for discharging air used for drying the object to be dried out of the drying drum 120, and a driver 140 that rotates the drying drum 120 at a predefined rotational speed.

An upper inlet 324 through which the object to be dried is inserted into the drying drum 120 may be defined in the upper front panel 300. An upper door 113 to open and close the upper inlet 324 may be disposed at the upper front panel 300. A control panel 114 for controlling the upper treating apparatus 100 and the lower treating apparatus 200 may be disposed at a lower level of the upper front panel 300.

In this connection, the control panel 114 may include a manipulator (not shown) for simultaneous or selective control of the upper treating apparatus 100 and the lower treating apparatus 200, and a display (not shown) for simultaneous or selective display of operating statuses of the upper treating apparatus 100 and the lower treating apparatus 200.

A decoration panel 400 that defines a top front face of the upper treating apparatus 100 may be disposed at a top level of the upper front panel 300. The upper top panel 150 that defines a top face of the upper treating apparatus 100 is disposed in rear of the decoration panel 400. In this connection, the decoration panel 400 may be fixed in a fitting manner to a top face of upper front panel 300. The upper top panel 150 may be seated on a top face of the upper side panel 117 and a top face of the upper rear panel 118 in a rear to front direction and may be supported on the decoration panel 400 and then be fixed thereto using a separate fastener (not shown).

The upper side panel 117 and the upper rear panel 118 may have separate plate forms or may be formed in an integral manner to each other by bending one panel. The upper side panel 117 and the upper rear panel 118 may be integrally formed to improve a strength of the upper treating apparatus 100.

The upper rear panel 118 may have a service panel (not shown) which defines a rear portion of the upper treating apparatus 100, and opens and closes the upper rear panel 118 for maintenance of the upper treating apparatus 100. Further, an air discharge duct 135 of the air flow path 130 to be described later may pass through the upper rear panel 118.

The upper base panel 119 has a mount face (not shown) on which each of the components (for example, the drying drum 120, the air flow path 130, the driver 140, etc.) of the upper treating apparatus 100 is installed. The upper base panel 119 may be made of a material selected depending on a temperature of a heater 132 in the air flow path 130 of the upper treating apparatus 100.

For example, when the heater 132 includes an electric heater (or a gas burner) generating a relatively high temperature as in an embodiment of the present disclosure, the upper base panel 119 may be made of a metal material. When the heater 132 includes a heat pump that generates a relatively low temperature, the upper base panel 119 may be made of a synthetic resin material.

In the present disclosure, an example in which the lower base panel 219*a* includes a metal plate will be described. In other words, when the lower base panel 219*a* includes the metal plate, thermal deformation thereof due to the heater 132 generating the high-temperature may be prevented. Further, the heat generated from the heater 132 may be prevented from being transferred to the lower treating apparatus 200.

The drying drum 120 may be formed in a cylindrical shape having open front and rear faces. A front plate 121 and a rear plate 126 that rotatably support the drying drum 120 may be disposed in front and rear of the drying drum 120, respectively.

The front plate 121 has an opening 122 defined therein that communicates with the upper inlet 324 defined in the upper front panel 300. The front plate 121 has a front support 123 disposed around an outer circumferential face of the opening 122 and in front of the drying drum 120 and supporting a front inner circumferential face of the drying drum 120.

A front roller 124 is disposed below the front support 123 to rotatably support a front lower portion of the drying drum 120. A plurality of air intake holes 125 through which air from the drying drum 120 is sucked into the air flow path 130 are formed in a lower portion of the front plate 121. The air intake duct 133 of the air flow path 130 is connected to the air intake holes 125.

The rear plate 126 has a plurality of air supply holes 127 defined therein to which the air supply duct 131 of the air flow path 130 to be described later is connected and through which air is supplied into the drying drum 120. A rear support 128 that supports a rear inner circumferential face of the drying drum 120 is disposed outside the air supply hole 127 and in rear of the drying drum 120. A rear roller 129 that rotatably supports a bottom of the drying drum 120 is disposed below the rear support 128.

The air flow path 130 includes the air intake duct 133 communicating with the air intake holes 125 to intake air in the drying drum 120, a fan 134 disposed in the air intake duct 133, an air discharge duct 135 for discharging air moved by the fan 134 outside the upper treating apparatus 100, an air supply duct 131 connected to the air supply holes 127 and intaking air outside the drying drum 120 and supplying the air to the drying drum 120, and the heater 132 that is disposed inside the air supply duct 131 to heat the inhaled air.

In this connection, air in the drying drum 120 is sucked into the air flow path 130, through the air intake duct 133 according to the operation of the fan 134, thereby reducing a pressure of the drying drum 120. As the pressure of the drying drum 120 decreases, air outside the drying drum 120 is supplied to the inside of the drying drum 120 through the air supply duct 131. In this connection, air moving through the air supply duct 131 is heated by the heater 132 disposed in the air supply duct 131 and supplied to the inside of the drying drum 120.

The driver 140 is configured to rotate the drying drum 120 at a predefined rotational speed. The driver 140 may have a motor 141 that generates power, a pulley 142 disposed on a rotation shaft of the motor 141, and a belt 145 connecting the pulley 142 and an outer circumferential face of the drying drum 120.

In this connection, the pulley 142 may be disposed on one end of the rotation shaft of the motor 141, and the fan 134 of the air flow path 130 may be disposed at the other end of the rotation shaft. That is, one motor 141 may be used to simultaneously operate the fan 134 of the air flow path 130 and the drying drum 120. In this case, the drying drum 120 and the fan 134 may be driven by the single motor 141, so that the drying drum 120 and the fan 134 may rotate at a constant rotation speed ratio and at a constant rotation speed.

In another example, although not shown, separate motors (not shown) may be disposed on the drying drum 120 and the fan 134, respectively. When the separate motors are disposed on the drying drum 120 and fan 134, respectively, the rotation speeds of the drying drum 120 and the fan 134 may be individually controlled.

In the above-described upper treating apparatus 100, as the object to be dried is injected into the drying drum 120 through the upper inlet 324, the drying drum 120 is rotated by the driver 140, and thus the object to be dried inside the drying drum 120 moves.

Further, as the fan 134 is rotated by the driver 140, the air inside the drying drum 120 is exhausted to the outside of the upper treating apparatus 100 through the air intake duct 133 and the air discharge duct 135, and at the same time, air outside the drying drum 120 is supplied to the drying drum 120 through the air supply duct 131.

In this connection, the air flowing into the drying drum 120 through the air supply duct 131 is heated by the heater 132 disposed in the air supply duct 131 and is converted into high-temperature air, which is in turn supplied to the inside of the drying drum 120, thereby to dry the object to be dried that moves under the rotation of the drying drum 120.

The lower treating apparatus 200 includes a lower cabinet 210 defining a lower appearance thereof, and including a lower front panel 211, a lower side panel 214, a lower rear panel 219 and a lower base panel 219*a*, a tub 220 disposed inside the lower cabinet 210 to store washing-water therein, a washing drum 240 that is rotatably disposed inside the tub 220 to wash the input washing target, a driver 230 which is disposed in rear of the tub 220 to rotate the washing drum 240, a water supply 250 that supplies washing-water to the tub 220, a detergent supply 252 that mixes detergent and the washing-water supplied from the water supply with each other to supply the mixture to the washing drum, and a water discharger 260 that drains the washing-water inside the tub 220.

The lower front panel 211 has an lower inlet 212 defined therein through which the object to be washed is input into the washing drum 240. A lower door 213 for opening and closing the lower inlet 212 is disposed on the lower front panel 211.

The lower side panel 214 and the lower rear panel 219 may be provided in separate plate forms, or may be formed integrally to each other by bending one panel. The lower side panel 214 and the lower rear panel 219 may be integrally formed to improve strength of the lower treating apparatus 200.

The lower front panel 211 and the lower side panel 214 as above-described and the upper front panel 300 and the upper side panel 117 may constitute the same vertically extending layers, respectively. That is, the lower front panel 211, the upper front panel 300 and the control panel 114 located at a lower portion of the upper front panel 300 may constitute the same vertically extending layer.

Further, the upper side panel 117 and the lower side panel 214 may define left and right sides of the upper treating apparatus 100 and the lower treating apparatus 200, respectively, and may constitute the same vertically extending layers.

The lower rear panel 219 may have a service panel (not shown) which defines a rear portion of the lower treating apparatus 200, and which opens and closes the lower rear panel 219 for maintenance of the lower treating apparatus 200. Further, a water supply pipe 251 of the water supply 250 and a water discharge pipe 263 of the water discharger 260 to be described later may pass through the lower rear panel 219.

In one example, the lower treating apparatus 200 according to the present disclosure may support the upper treating apparatus 100 thereon. That is, the upper treating apparatus 100 is disposed on the top of the lower treating apparatus 200 according to the present disclosure. The top face of the lower treating apparatus 200 is covered with the upper treating apparatus 100.

The tub 220 is disposed inside the lower cabinet 210 and is formed in a cylindrical shape and moves via a suspension 222 such as a spring and a damper. A tub opening 221 that communicates with the lower inlet 212 formed in the lower front panel 211 is formed in a front face of the tub 220. The lower inlet 212 of the lower front panel 211 and the tub opening 221 may further have a bellows type gasket 223 to maintain watertightness when the tub 220 moves.

The driver 230 is disposed on a rear face of the tub 220 to rotate the washing drum 240, and has an outer rotor type motor 232 disposed on the rear face of the tub 220 and a rotation shaft 231 that passes through the rear face of the tub 220 and transmits the rotational force of the motor 232.

The washing drum 240 is disposed in inside the tub 220 and is formed in a cylindrical shape and is connected to the rotation shaft 231 so that the drum 240 rotates. The washing drum 240 has a drum opening 241 defined in a front face thereof communicating with the tub opening 221 formed in the tub 220. The object to be washed is injected through the drum opening 241 to the drum 240. Further, a plurality of water communication holes 242 for flowing the washing-water may be defined in an inner circumferential face of the washing drum 240. A plurality of lifters 243 for moving the object to be washed may be disposed in the washing drum 240.

The water supply 250 receives washing-water from an external water supply source (not shown) to the laundry treating apparatus 10. The water supply 250 includes a water supply pipe 251 to which the external water supply source is connected, and a detergent supply 252 connected to the water supply pipe 251 and mixing the water and detergent and supplying the mixture to the tub 220, and a water supply hose 253 connecting the detergent supply 252 and the tub 220 to each other.

The water discharger 260 is disposed under the tub 220 to drain the washing-water that has been used in the tub 220. The water discharger 260 includes a water discharge hose 261 connected to a bottom face of the tub 220, the water discharge pump 262 disposed at the water discharge hose 261 to pump the washing-water, and a water discharge pipe 253 to discharge the washing-water pumped by the water discharge pump 262 to the outside.

In the lower treating apparatus 200 as described above, as the object to be washed is introduced into the washing drum 240 through the lower inlet 212, the detergent and washing-water are supplied to the tub 220 from the water supply 250. As the washing drum 240 rotates by the driver 230, the object to be washed inside the washing drum 240 moves and the washing process proceeds.

Further, as the washing process is completed, the washing-water inside the tub 220 is discharged to the outside of the lower treating apparatus 200 by the water discharge pump 262 of the water discharger 260, thereby completing the washing process.

In one example, the lower treating apparatus 200 is installed on an installation place, and then the upper treating apparatus 100 is seated on the top of the lower treating apparatus 200, thereby completing the installation of the laundry treating apparatus 10.

In one example, water may be introduced into the upper treating apparatus 100 as described above through a top of the upper front panel 300 due to a shape of the upper front panel 300. In particular, as described above, during manufacturing of the upper front panel 300, a cut slit 332 must be formed in a top of the upper front panel 300. Water may flow into the upper treating apparatus 100 through this cut slit 332.

Hereinafter, the upper front panel 300, the decoration panel 400, and the upper top panel 150 of the upper treating apparatus 100 according to an embodiment of the present disclosure will be described in detail with reference to the accompanying drawings.

Figure 3:
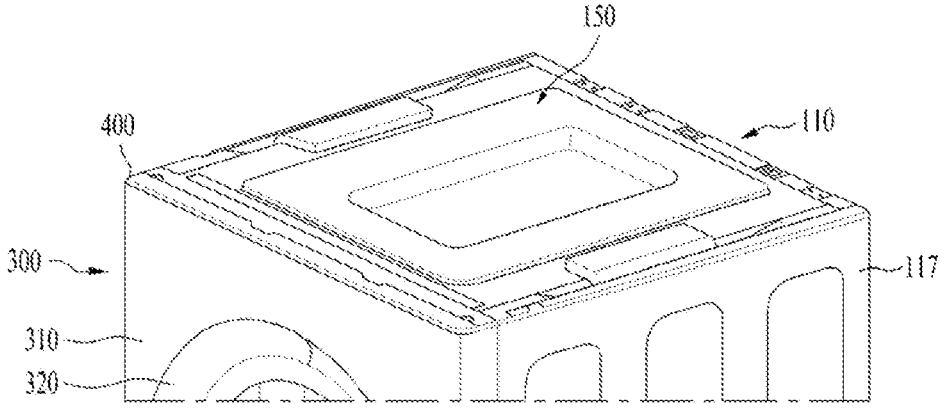
FIG. 3 is a perspective view showing a top face of an upper treating apparatus according to an embodiment of the present disclosure.
Figure 4:
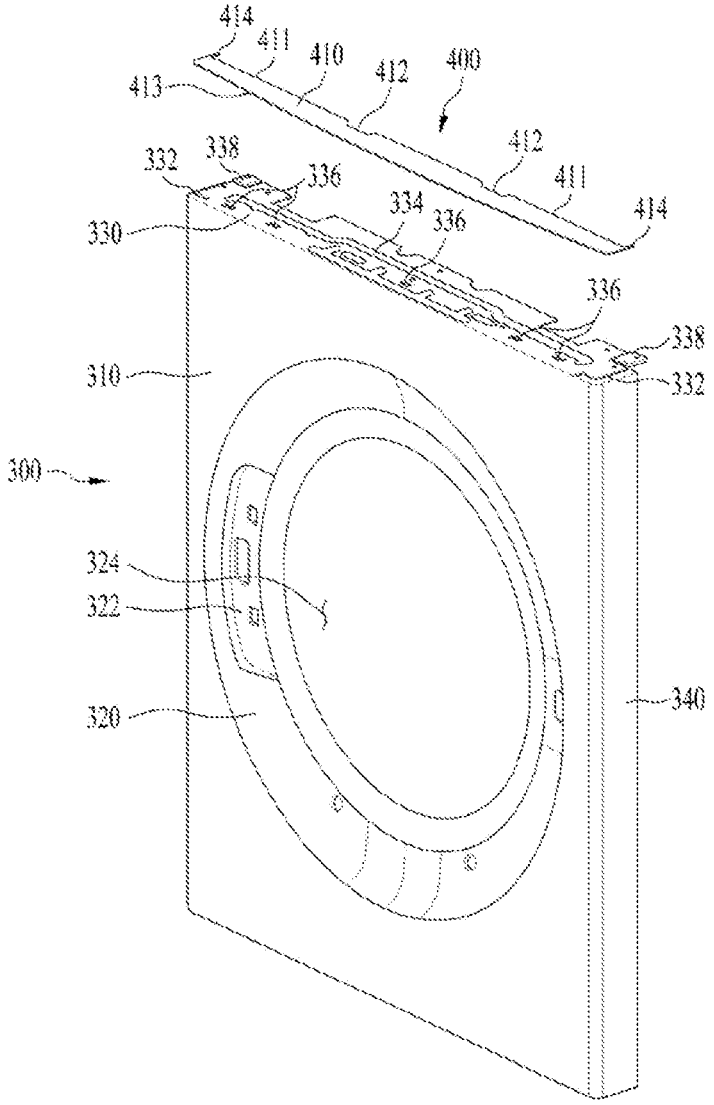
FIG. 4 is an exploded perspective view showing a front panel of an upper treating apparatus according to an embodiment of the present disclosure.
Figure 5:
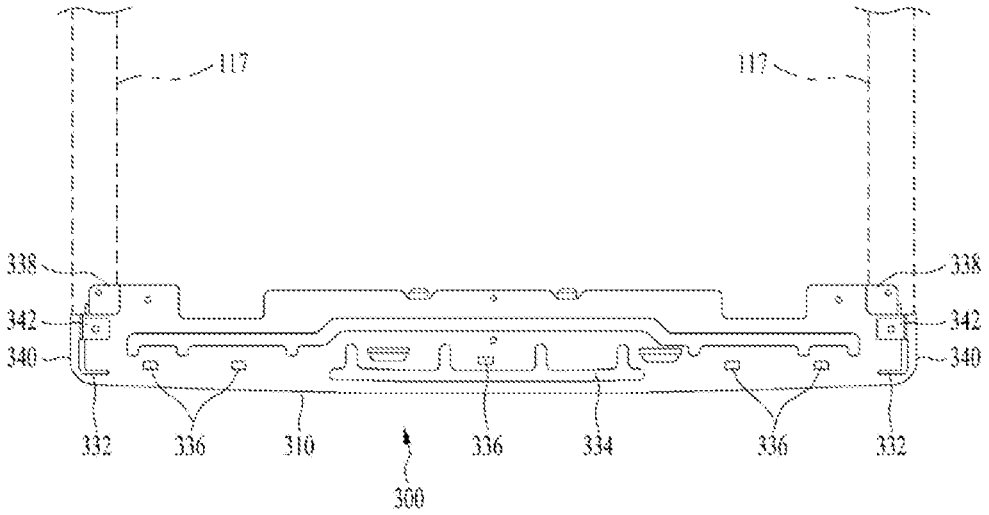
FIG. 5 is a plan view showing a front panel of an upper treating apparatus according to an embodiment of the present disclosure.
Figure 6:
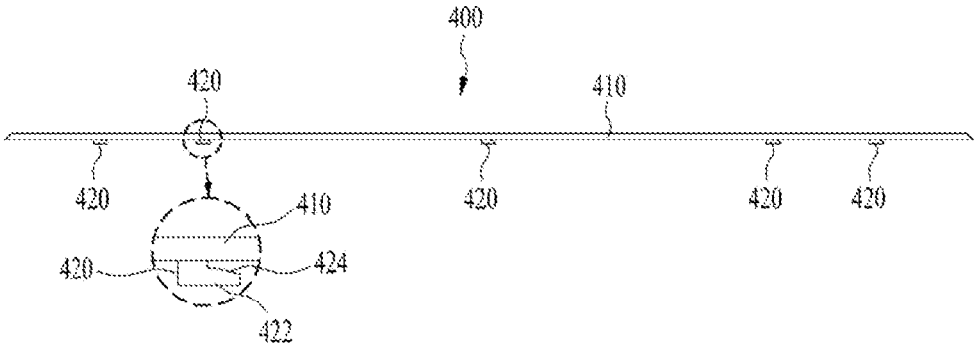
FIG. 6 is a front view showing a decoration panel of an upper treating apparatus according to an embodiment of the present disclosure.

FIG. 3 is a perspective view showing a top face of the upper treating apparatus according to an embodiment of the present disclosure. FIG. 4 is an exploded perspective view showing the front panel of the upper treating apparatus according to an embodiment of the present disclosure. FIG. 5 is a plan view showing the front panel of the upper treating apparatus according to an embodiment of the present disclosure. FIG. 6 is a front view showing the decoration panel of the upper treating apparatus according to an embodiment of the present disclosure.

In following descriptions, for convenience of description, the upper treating apparatus 100 will be described by way of example. However, a structure according to the present disclosure may also be applied to the lower treating apparatus 200, and may be applied not only to a stack-type laundry treating apparatus 10 but also to a laundry treating apparatus that is installed independently.

As shown, a top of the upper treating apparatus 100 include a top of the upper front panel 300, the decoration panel 400 mounted on a top of the upper front panel 300 and coupled to block water flowing into the top of the upper front panel 300, and the upper top panel 150 that is coupled to the upper side panel 117 and is disposed in rear of the decoration panel 400. The decoration panel 400 may limit a forward movement of the upper top panel 150.

The upper front panel 300 may be formed by pressing-molding a metal plate made of a steel or stainless steel. The upper front panel 300 may include an upper front portion 310 defining a front face of the upper front panel 300, and side bent portions 340 defining both sides of the upper front panel 300. The side bent portions 340 may be formed by bending the plate rearwards from both sides of the upper front portion 310.

A door receiving portion 320 on which the upper door 113 is installed is formed in a central region of the upper front portion 310. The door receiving portion 320 is recessed into the upper front portion 310. In a center region of the door receiving portion 320, the upper inlet 324 is formed through which the object to be dried is inserted into the drying drum 120.

Although not shown on one side of the door receiving portion 320, a hinge type coupler 322 is installed which has a hinge (not shown) to which the upper door 113 is pivotably coupled, so that the upper door 113 is pivotally supported with respect to the door receiving portion 320.

A top bent portion 330 extends horizontally and rearwards from a top face of the upper front portion 310 and defines a top face of the upper front panel 300. A plurality of reinforcing grooves 334 may be recessed in the top bent portion 330 to reinforce strength of the top bent portion 330. The plurality of reinforcing grooves 334 may extend in a length direction and a width direction of the top bent portion 330.

At least two mounting holes 336 into which mounting protrusion 420 of the decoration panel 400 to be described later are inserted and fixed may be arranged in the longitudinal direction of the top bent portion 330. The mounting hole 336 may be formed in a rectangular shape such that the mounting protrusion 420 of the decoration panel 400 is inserted into the mounting hole 336 and then moved in the longitudinal direction of the top bent portion 330.

A stopper supporting a bottom of the upper top panel 150 may protrude from a width direction end of the top bent portion 330. The stopper may extend downward from a surface of the top bent portion 330 to support the bottom of the upper top panel 150.

The side bent portion 340 is formed by bending a metal plate from each of both sides of the upper front portion 310 to the upper side panel 117. The upper side panel 117 and the side bent portions 340 define both sides of the upper treating apparatus 100. A connection end 342 protrudes from a top of the side bent portion 340. The connection end 342 is bent toward the top bent portion 330 and is coupled to the top bent portion 330 by a separate fastener (not shown).

In one example, both longitudinal ends of the top bent portion 330 and the tops of both side bent portions 340 may be coupled to each other via the connection end 342. In this case, a remaining portion thereof not coupled via the connection end 342 for a design tolerance and an assembly tolerance acts as as an extra space for fastening the connection end 342. After the top bent portion 330 and the side bent portion 340 are connected to the connection end 342, the cut slit 332 is formed.

In this connection, through the cut slit 332, water flowing from the top of the upper front panel 300 may flow into the interior of the upper treating apparatus 100. The decoration panel 400 is coupled to the top bent portion 330 of the upper front panel 300 to prevent the inflow of water through the cut slit 332. The decoration panel 400 is formed to cover a front face of the top bent portion 330 while being in close contact with the top face of the top bent portion 330.

The decoration panel 400 includes a top plate 410 formed in a plate shape corresponding to a top face shape of the top bent portion 330, and mounting protrusions 420 protruding from a bottom face of the top plate 410 and inserted into the mounting holes 336 of the top bent portion 330.

In this connection, the top plate 410 has a predefined thickness. A front face thereof has a shape corresponding to a top shape of the upper front panel 300. A rear face thereof has a shape corresponding to a shape of a front face of the upper top panel 150.

In one example, a front inclined face 413 that is inclined downward to a front portion of the upper front panel 300 is formed on a top of a front face of the top plate 410. The front inclined face 413 connects the top plate 410 to a front face of a top of the upper front panel 300, and increases aesthetic feeling of the upper front panel 300 and the top plate 410.

Further, a rear face of the top plate 410 may act as a support face 411 so that the front face of the upper top panel 150 limits the movement of the upper top panel 150 when the upper top panel 150 is installed. In this connection, the support face 411 of the top plate 410 may further have a groove 412 defined therein and having a shape corresponding to a shape of the front face of the upper top panel 150. A portion of the upper top panel 150 may be inserted into the groove 412.

In one example, an extension protrusion 414 extending from the top plate 410 to the upper side panel 117 may be further formed on each of both ends in a longitudinal direction of the top plate 410. The extension protrusion 414 may extend to cover a top face of the connection end 342 connecting the top bent portion 330 and the side bent portion 340 of the upper front panel 300 to each other.

Further, a recessed face 415 recessed into the top plate 410 may be further formed in a bottom face of the top plate 410. The recessed face 415 may be defined in the bottom face of the top plate 410 and may be spaced from an outer circumferential face of the top plate 410 by a predefined spacing.

When the top plate 410 is seated on the top bent portion 330 of the upper front panel 300, this recessed face 415 may allow the top plate 410 to closely contact the top bent portion 330 even when the top bent portion 330 is deformed or relatively small foreign substances exist thereon.

In other words, due to an inner shape of the recessed face 415 formed in the bottom face of the top plate 410, the installation of the decoration panel 400 may not be relatively affected even when the top face of the top bent portion 330 is deformed or relatively small foreign substances are present thereon.

Further, a support protrusion 416 protruding toward the top bent portion 330 may be further formed on the recessed face 415. The support protrusion 416 may include a plurality of protrusions protruding from an inner face of the recessed face 415 toward the top bent portion 330 or a rib protruding from an inner face of the recessed face 415 toward the top bent portion 330.

The support protrusion 416 may maintain a spacing between the top plate 410 and the top bent portion 330 even though an area of the recessed face 415 is relatively large, thereby preventing deformation of the decoration panel 400.

Further, the above-described recessed face 415 may prevent deformation during manufacturing of the top plate 410. That is, the decoration panel 400 may be manufactured by injection molding of a synthetic resin as a plastic material. When the decoration panel 400 is manufactured by the injection molding, shrinkage of the top plate 410 may occur due to a thickness of the top plate 410. However, the shrinkage of the top plate 410 may be prevented by the recessed face 415.

In one example, each mounting protrusion 420 protrudes from the bottom face of the top plate 410 and is inserted into the mounting hole 336 formed in the top bent portion 330 to support the top plate 410 so that the top plate 410 may be fixed to the top bent portion. The mounting protrusion 420 is formed at a position corresponding to a position of the mounting hole 336 formed in the top bent portion 330.

In this connection, a stopper protrusion 422 extending to one end in a longitudinal direction of the top plate 410 is formed on an end of a bottom of each mounting protrusion 420. An inclined face 424 inclined downwards in a direction away from the mounting protrusion 420 is formed on a top face of an end of the stopper protrusion 422.

This inclined face 424 may be easily moved without getting caught in the mounting hole 336 after the mounting protrusion is inserted into the mounting hole 336 when the top plate 410 is coupled to the top bent portion 330.

Further, when the decoration panel 400 is coupled to the top bent portion 330, the inclined face 424, and as the decoration panel 400 moves, the inclined face 424 slides on the mounting hole 336, so that the top plate 410 closely contacts the top bent portion 330.

Figure 7:
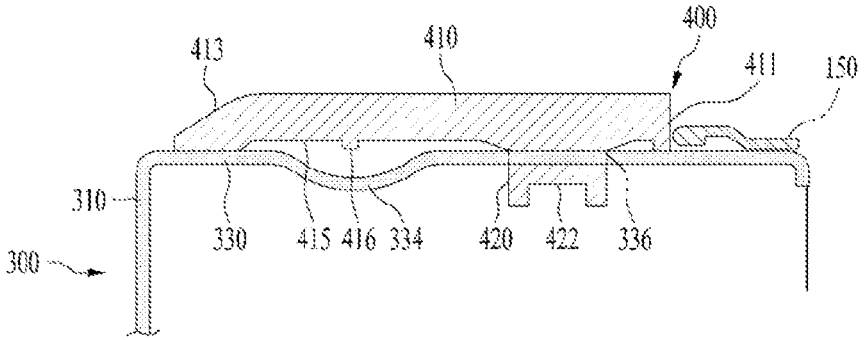
FIG. 7 is a cross-sectional view showing a coupled state between a front panel and a decoration panel of an upper treating apparatus according to an embodiment of the present disclosure.

The decoration panel 400 as described above may be coupled to the top face of the top bent portion 330 of the upper front panel 300 to support the upper top panel 150, as shown in FIG. 7. That is, the decoration panel 400 is coupled to the top bent portion 330 of the upper front panel 300 in a lateral direction of the upper front panel 300 and is fixed to the top bent portion 330. The upper top panel 150 may be fixed to the upper side panel 117 by a separate fastener (not shown) while being coupled to the top of the upper side panel 117 in the front direction and is in contact with the support face of the decoration panel 400.

Hereinafter, the installation process of the decoration panel 400 and the upper top panel 150 will be described with reference to the attached drawings.

Figure 8A:
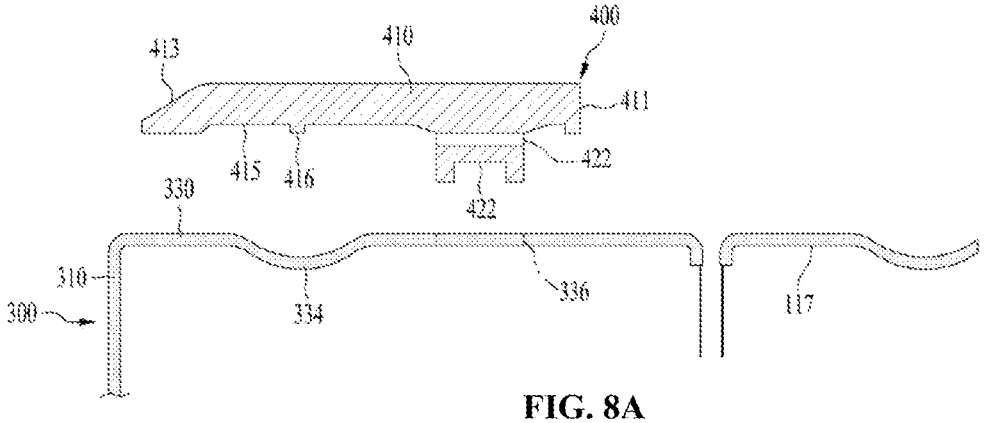
FIGS. 8A to 8C are simplified diagrams showing a coupled state of a decoration panel and an upper top panel of an upper treating apparatus according to an embodiment of the present disclosure.
Figure 8B:
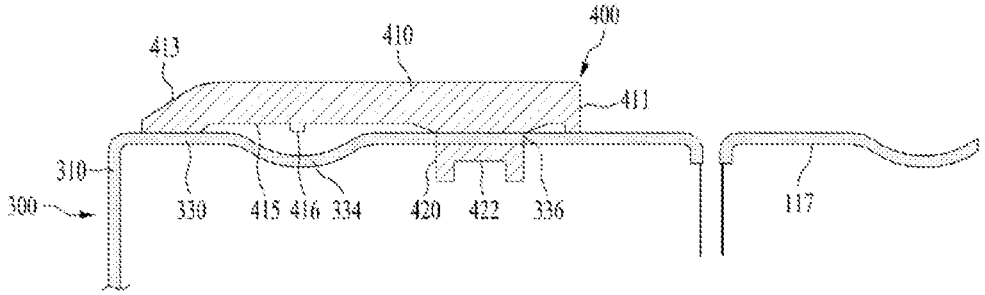
Figure 8C:
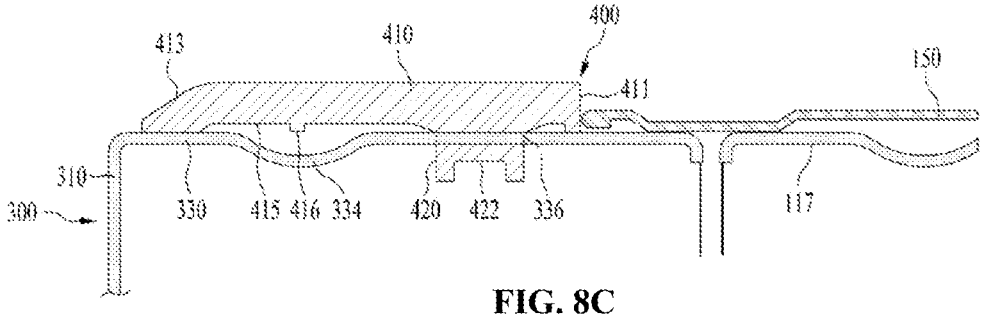

FIGS. 8A to 8C are simplified diagrams showing a coupled state of the decoration panel 400 and the upper top panel 150 of the upper treating apparatus 100 according to an embodiment of the present disclosure. In this connection, FIG. 8A shows a state before the decoration panel 400 and upper top panel 150 are installed. FIG. 8B shows a state where the decoration panel 400 is installed on the upper front panel 300. FIG. 8C shows a state where the decoration panel 400 and the upper top panel 150 are installed.

As shown in FIG. 8A, the upper front panel 300 and the upper side panel 117 are connected to each other via a side panel connector 338 formed on the upper front panel 300. The top bent portion 330 of the upper front panel 300 and the top face of the upper side panel 117 constitute the same plane.

In this connection, as the decoration panel 400 moves downwards above the top bent portion 330, the mounting protrusion 420 of the top plate 410 is inserted into the mounting hole 336 of the top bent portion 330.

Thereafter, as shown in FIG. 8B, when the top plate 410 is seated on the top face of the top bent portion 330, the mounting protrusion 420 formed on the bottom face of the top plate 410 has been inserted into the mounting hole 336 of the top bent portion 330.

In one example, the stopper protrusion of the mounting protrusion 420 formed on the bottom face of the top plate passes through the mounting hole of the top bent portion and is located on the bottom face of the top bent portion. As the top plate moves in the lateral direction of the upper front panel, the support protrusion supports the bottom face of the top bent portion.

In this connection, the stopper protrusion is not caught on the mounting protrusion 420 due to the inclined face inclined downward in a moving direction of the top plate. As the top plate moves in the lateral direction, the top plate 410 may be coupled to the top bent portion 330 by a strong clamping force due to the inclined face.

Thereafter, as shown in FIG. 8C, after the decoration panel 400 is coupled to the top bent portion 330 of the upper front panel 300, the upper top panel 150 may be installed in rear of the decoration panel 400. In this connection, the upper top panel 150 may be connected to the decoration panel 400 as moving from the top of the upper side panel 117 toward the support face of the decoration panel 400.

That is, in order to install the upper top panel 150, the upper top panel 150 may be seated on a rear portion of the top of the upper side panel 117. Then, the upper top panel 150 may move to the decoration panel 400. When the moving upper top panel 150 contacts the support face 411 of the decoration panel 400, the movement thereof is restricted. In this state, the upper top panel 150 may be fixed to the upper side panel 117 by a separate fastener (not shown).

In this connection, the cut slit 332 formed between the top bent portion 330 and the side bent portion 340 of the upper front panel 300 may be covered by the top plate 410 of the decoration panel 400 so that the inflow of water through the cut slit 332 into the upper treating apparatus may be prevented.

Further, the decoration panel 400 coupled to the top bent portion 330 of the upper front panel 300 defines the top face of the upper front panel 300. Thus, beauty of an appearance of the upper treating apparatus 100 may be improved by the front inclined face 413 formed on the top plate 410 of the decoration panel 400.

As described above, the preferred embodiments according to the present disclosure has been described in detail. However, a person with ordinary knowledge in the technical field to which the present disclosure belongs may implement the present disclosure in various modified manners without deviating from the scope and the spirit of the present disclosure defined in the appended claims. Therefore, the modifications of the embodiments according to the present disclosure may fall into the scope of the present disclosure.

What is claimed is:

1. A stack-type laundry treating system comprising:

an upper treating apparatus including:

an upper cabinet, a drying drum disposed in the upper cabinet and configured to rotate, the drying drum being configured to receive an object to be dried, an upper driver configured to rotate the drying drum, and an air flow passage configured to supply air to and discharge air from the drying drum; and a lower treating apparatus including:

a lower cabinet, a tub disposed in the lower cabinet and configured to receive washing-water, a washing drum disposed inside the tub and configured to receive an object to be washed, and a lower driver configured to rotate the washing drum, wherein the upper cabinet includes:

an upper front panel defining a front face of the upper cabinet, a cut slit being defined at a top of the upper front panel, the upper front panel defining a laundry inlet, a door disposed at the upper front panel, upper side panels defining opposite side faces of the upper cabinet, a decoration panel coupled to the top of the upper front panel and covering the cut slit, and an upper top panel coupled to the upper side panels, wherein the upper front panel includes:

a top bent portion that is coupled to the decoration panel; and side bent portions that are located at opposite sides of the upper front panel and contact the upper side panels, wherein the cut slit is defined between the top bent portion and the side bent portion.

2. The system of claim 1, wherein the decoration panel is disposed on the top bent portion and extends along the top bent portion toward the side bent portions.

3. The system of claim 1, wherein each of the side bent portions includes a connection end coupled to the top bent portion, wherein the decoration panel is disposed at the connection end.

4. The system of claim 1, wherein the top bent portion defines a plurality of mounting holes, wherein the decoration panel has a plurality of mounting protrusions that are inserted into the plurality of mounting holes of the top bent portion.

5. The system of claim 4, wherein the decoration panel includes:

a top plate having a shape corresponding to a shape of the top bent portion;

wherein the plurality of mounting protrusions of the decoration panel are located at a bottom face of the top plate and correspond to positions of the plurality of mounting holes of the top bent portion.

6. The system of claim 5, wherein each of the plurality of mounting holes of the top bent portion has a rectangular shape extending in a first direction, the first direction extending between opposite sides of the system, and wherein the plurality of mounting protrusions of the decoration panel are configured to be received into and fixed at the plurality of mounting holes of the top bent portion based on the top plate moving in the first direction.

7. The system of claim 6, wherein each of the plurality of mounting protrusions of the decoration panel has a stopper protrusion that is spaced downward from the top plate and extends in a lateral side-to-side direction of the top plate.

8. The system of claim 7, wherein a top face of the stopper protrusion has an inclined face that is inclined downward in the lateral side-to-side direction of the top plate.

9. The system of claim 5, wherein the top plate includes a rear face having a shape corresponding to a shape of a front end of the upper top panel to thereby support the front end of the upper top panel.

10. The system of claim 5, wherein the top plate defines a recess at the bottom face of the top plate.

11. The system of claim 10, wherein the top plate includes a support protrusion that is defined at an inner horizontal face of the recess and extends toward the top bent portion.

12. The system of claim 1, wherein the top bent portion defines a plurality of reinforcing grooves.

13. A laundry treating apparatus comprising:

a cabinet;

a drum disposed in the cabinet and configured to rotate; and a driver configured to rotate the drum, wherein the cabinet includes:

a front panel defining a front face of the cabinet, a cut slit being defined at a top of the front panel, the front panel defining a laundry inlet;

a door disposed at the front panel;

side panels defining opposite side faces of the cabinet;

a decoration panel coupled to the top of the front panel and covering the cut slit; and a top panel coupled to the side panels, wherein the front panel includes:

a top bent portion on which the decoration panel is disposed, the top bent portion defining a plurality of mounting holes; and side bent portions that are located at opposite sides of the front panel and contact the side panels, wherein the cut slit is defined between the top bent portion and the side bent portions.

14. The system of claim 13, wherein the decoration panel includes:

a top plate having a shape corresponding to a shape of the top bent portion; and a plurality of mounting protrusions that are located at a bottom face of the top plate and correspond to positions of the plurality of mounting holes of the top bent portion.

15. The apparatus of claim 14, wherein each of the side bent portions includes a connection end coupled to the top bent portion, wherein the decoration panel is disposed at the connection end.

16. The apparatus of claim 14, wherein each of the plurality of mounting holes has a rectangular shape extending in a first direction, the first direction extending between opposite sides of the apparatus, and wherein each of the plurality of mounting protrusions has a stopper protrusion that is spaced downward from the top plate and extends in a lateral side-to-side direction of the top plate.

17. The apparatus of claim 16, wherein a top face of the stopper protrusion has an inclined face that is inclined downward in the lateral side-to-side direction of the top plate.

18. The apparatus of claim 14, wherein the top plate includes a rear face having a shape corresponding to a shape of a front end of the top panel to thereby support the front end of the top panel.

* * * * *